US008530129B2

(12) United States Patent
Hama et al.

(10) Patent No.: US 8,530,129 B2
(45) Date of Patent: Sep. 10, 2013

(54) IMAGE FORMING METHOD

(75) Inventors: Masayuki Hama, Yokohama (JP); Masaya Kawada, Yokohama (JP); Masaharu Miura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 150 days.

(21) Appl. No.: 13/175,156

(22) Filed: Jul. 1, 2011

(65) Prior Publication Data

US 2012/0003580 A1 Jan. 5, 2012

(30) Foreign Application Priority Data

Jul. 5, 2010 (JP) ..... 2010-152635

(51) Int. Cl.
*G03G 13/08* (2006.01)

(52) U.S. Cl.
USPC ..... 430/123.51; 430/108.1; 430/108.6

(58) Field of Classification Search
USPC ..... 430/108.1, 108.6, 123.51
See application file for complete search history.

(56) References Cited

U.S. PATENT DOCUMENTS

| | | | | |
|---|---|---|---|---|
| 5,561,021 | A | 10/1996 | Yamazaki et al. | |
| 5,733,702 | A | 3/1998 | Okado et al. | |
| 5,797,072 | A | 8/1998 | Ehara et al. | |
| 6,108,502 | A | 8/2000 | Kawada et al. | |
| 6,171,742 | B1 | 1/2001 | Kawada et al. | |
| 6,226,479 | B1 | 5/2001 | Karaki et al. | |
| 6,586,149 | B2 | 7/2003 | Kawamura et al. | |
| 6,636,715 | B2 | 10/2003 | Kawamura et al. | |
| 7,060,406 | B2 | 6/2006 | Kawamura et al. | |
| 2006/0018689 | A1 * | 1/2006 | Hildebrand et al. | 399/343 |
| 2008/0112742 | A1 | 5/2008 | Nakamori et al. | |

FOREIGN PATENT DOCUMENTS

| | | | |
|---|---|---|---|
| EP | 0 869 397 | A2 | 10/1998 |
| JP | 2008-122593 | A | 5/2008 |
| JP | 2008-304788 | A | 12/2008 |

OTHER PUBLICATIONS

European Search Report dated Nov. 17, 2011 in European Application No. 11005412.9.

* cited by examiner

*Primary Examiner* — Peter Vajda

(74) *Attorney, Agent, or Firm* — Fitzpatrick, Cella, Harper and Scinto

(57) ABSTRACT

Provided is an image forming method in which hydrophobized calcium carbonate particles having a number average particle diameter of 30 to 300 nm and hydrophobized strontium titanate particles having a number average particle diameter of 30 to 300 nm are applied to the surface of an image bearing member.

7 Claims, 2 Drawing Sheets

IMAGE FORMING METHOD

BACKGROUND OF THE INVENTION

1. Field of the Invention

The present invention relates to an electrophotographic image forming method. Specifically, the present invention relates to an image forming method comprising electrostatically charging the surface of an image bearing member in association with discharging in a charging step, forming an electrostatic latent image on the surface of the image bearing member in an exposing step, and developing the electrostatic latent image by a developer.

2. Description of the Related Art

In the image forming method used for electrophotographic apparatuses and electrostatic recording apparatuses are known a variety of methods for forming a latent image on an image bearing member such as an electrophotographic photosensitive member and an electrostatic recording dielectric medium.

For example, usually, the electrophotography uniformly charges a photosensitive member as a latent image bearing member using a photoconductive substance to a desired polarity and potential, and performs image pattern exposure to form an electric latent image. Then, the electric latent image is developed with a toner to form a visualized image, which is then transferred onto a transfer medium such as paper and fixed.

Recently, network-capable multifunction machines including all the output terminals such as a copier, a printer and a fax machine have been widely accepted in the market.

While the electrophotographic system is widely accepted as such a network-capable output terminal, examples of significant problems include a duty cycle of the main body. The duty cycle refers to the limit number of sheets by which the main body normally continues operating without maintenance by a worker.

Factors determining the duty cycle can include the life span of the image bearing member (photosensitive member). A longer life span of the photosensitive member can increase the duty cycle to improve reliability. Additionally, wastes can be reduced. From the viewpoint of environmental protection, development of such a technique is demanded.

In such a situation, highly durable photosensitive members such as amorphous silicon (a-Si) photosensitive members and organic photosensitive members having a protective layer made of a curable resin on the surface thereof have been increasingly used as the photosensitive member.

Unfortunately, because the highly durable photosensitive member is used for a long time for its high durability, the surface of the photosensitive member may be deteriorated, affecting the quality of the image.

The surface of the photosensitive member is deteriorated by fine paper powder produced from pieces of paper often used as a transfer material, an organic component originating from the paper powder, and a discharge product caused by a high-voltage member present in the apparatus using the photosensitive member. The fine paper powder, organic component or discharge product attached to the surface of the photosensitive member may make the electric resistance of the photosensitive member lowered particularly under a highly humid environment to interfere with formation of a sharp electrostatic latent image, leading to deterioration in the quality of the image.

Moreover, electric discharging by a charging apparatus may change the quality of the surface itself of the photosensitive member, leading to increased hydrophilicity. In this case, moisture is adsorbed to the areas of the photosensitive member with increased hydrophilicity to reduce the electric resistance, thereby interfering with formation of a sharp electrostatic latent image.

Also in the case where the image bearing member is an intermediate transfer member, the surface may be deteriorated by the influence of the paper powder or discharge product to tend to reduce the transfer performance of toner or cause toner fusing and insufficient cleaning of the image bearing member.

There is a method of removing a deteriorated surface portion of an image bearing member (particularly, photosensitive member) with the aid of a scraping member or a polishing agent to suppress the occurrence of problems. In this case, a method of externally adding a material having a high polishing ability to a toner to polish the photosensitive member surface is often used (see Japanese Patent Application Laid-Open No. 2008-304788). In the method by which the photosensitive member is scraped, however, the life span of the surface of the photosensitive member is likely to be reduced.

On the other hand, there is a method of coating a surface of a photosensitive member with a fatty acid metallic salt or the like as a protector, thereby to prevent image deletion (see Japanese Patent Application Laid-Open No. 2008-122593). Unfortunately, in the method using the photosensitive member protector, contamination of other apparatuses such as the charging apparatus and the developing apparatus by the photosensitive member protector may have a large influence to often reduce the life span of the apparatuses other than the photosensitive member. Moreover, if a discharge product is formed, the photosensitive member protector tends to be deteriorated to increase the adhesive force thereof. Accordingly, as the life span of the photosensitive member is prolonged, accumulation of the photosensitive member protector needs to be more cared.

SUMMARY OF THE INVENTION

As described above, the technique for preventing image deletion while the life span of the photosensitive member is prolonged still has room for improvement. In order to increase the life span of the photosensitive member and constituent members provided therearound, the image deletion is required to be more efficiently suppressed.

The present invention is directed to providing an image forming method in which the amount of an image bearing member surface to be scraped is reduced and the image deletion can be prevented to output an image with high quality.

Further, the present invention is directed to providing an image forming method that can prevent the image deletion even in the case where an image forming apparatus is left for a long time under a highly humid environment.

The present invention relates to an image forming method comprising a step of charging an image bearing member electrostatically in association with discharging; an exposing step of forming an electrostatic latent image on the surface of the image bearing member; a step of developing the electrostatic latent image with a developer to form a toner image; a step of transferring the toner image onto a transfer material through or without an intermediate transfer member; and a step of fixing the toner image on the transfer material, wherein, said method further comprises a step of applying onto the surface of the image bearing member, hydrophobized calcium carbonate particles having a number average particle diameter of 30 to 300 nm and strontium titanate particles having a number average particle diameter of 30 to 300 nm.

According to the present invention, since the calcium carbonate particles and the strontium titanate particles are applied to the surface of the photosensitive member as an image bearing member, the image deletion can be prevented from occurring both when an image is being formed and when the image forming apparatus is left for a long time, and images with high quality can be stably output.

Additionally, the present invention is also effective for reduction in vibration caused by friction between a cleaning blade and the photosensitive member and for prevention of uneven contamination of a charging member.

Further features of the present invention will become apparent from the following description of exemplary embodiments with reference to the attached drawings.

DESCRIPTION OF THE EMBODIMENTS

Figure 1:
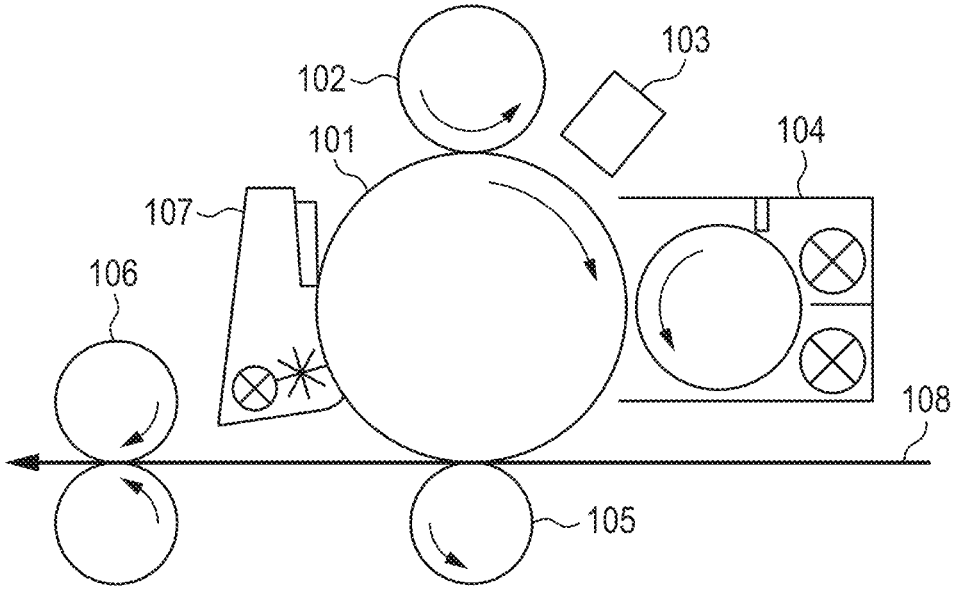
FIG. 1 is a schematic sectional view of an image forming apparatus to which an image forming method according to the present invention can be applied.
Figure 2:
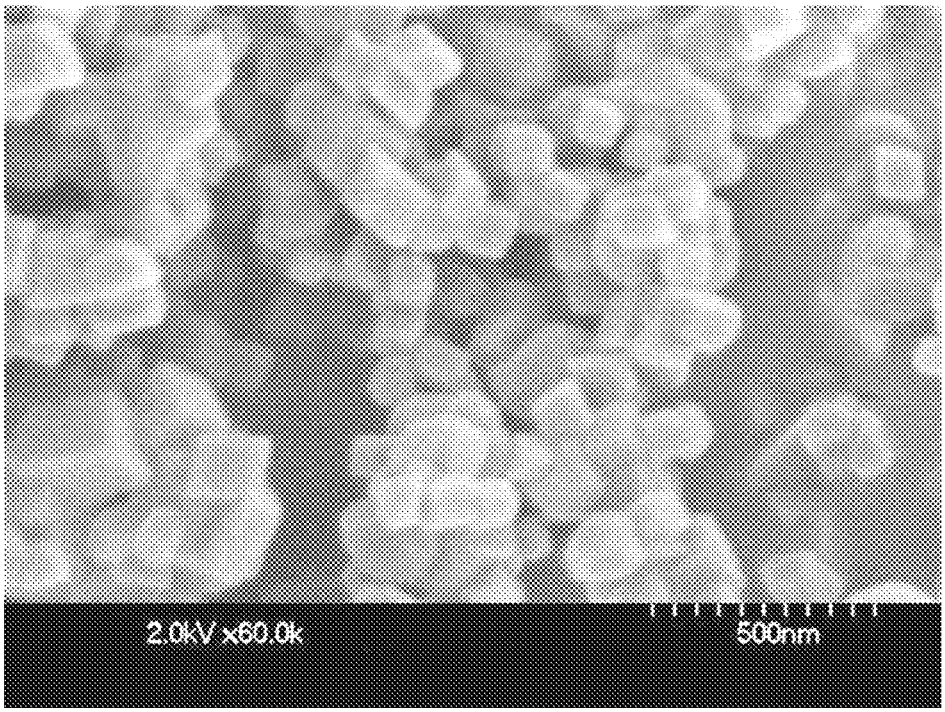
FIG. 2 is an enlarged picture of hexahedral calcium carbonate.

Preferred embodiments of the present invention will now be described in detail in accordance with the accompanying drawings.

The present inventors have analyzed in detail the phenomenon that the resistance of the surface of the photosensitive member is reduced to cause image deletion, and as a result, they have found out that there are two patterns in the situation where the image deletion is caused.

A first pattern is a pattern in which the image deletion is caused when the apparatus having formed a number of images is left for a long time and then is again started to output images. The surface of the photosensitive member is deteriorated to some extent to turn into a hydrophilic surface. Accordingly, a large amount of moisture in the air is adsorbed on the surface of the photosensitive member. Then, a discharge product existing in the photosensitive member or the main body of the image forming apparatus is dissolved into the moisture adsorbed on the surface of the photosensitive member to form low-resistance substances. Thus, the resistance of the surface of the photosensitive member is thereby reduced, leading to the image deletion. In this pattern, a relatively large amount of moisture exists on the surface. Accordingly, the present inventors assume that only a small amount of the discharge product dissolved reduces the resistance of the surface of the photosensitive member, leading to the image deletion.

A second pattern is a pattern in which the image deletion is caused at the time of formation of the image when the main body of the image forming apparatus is not sufficiently warmed. In this pattern, a discharge product formed during the formation of an image is dissolved into a small amount of the moisture on the surface of the photosensitive member to form low-resistance substances, and the resistance of the surface of the photosensitive member is reduced to cause the image deletion. In this pattern, the inventors assume that a large amount of the discharge product is dissolved into a small amount of the moisture to reduce the resistance of the surface of the photosensitive member, leading to the image deletion.

Among these patterns, the image deletion of the first pattern can be prevented by the conventional method, namely, by scraping the surface of the photosensitive member little by little to prevent the photosensitive member surface from being hydrophilic. In the case of the image deletion of the second pattern, however, the surface of the photosensitive member needs to be refreshed every time when an image is formed. Accordingly, if the problem of the image deletion is solved by scraping the surface of the photosensitive member, the amount of the photosensitive member to be scraped is extremely large.

Based on the results of the analysis, first, the present inventors have performed investigation in order to remove the low-resistance substances formed on the surface of the photosensitive member, which low-resistance substances cause the image deletion during the formation of an image. As a result of the investigation, it was found out that calcium carbonate demonstrates an effect. It was also found out that this effect by calcium carbonate is demonstrated by the fact that calcium carbonate chemically adsorbs the discharge product to remove the discharge product from the photosensitive member, but the effect is not demonstrated by the polishing action of scraping the photosensitive member.

Because the discharge product mainly shows acidity, the surface of the photosensitive member having such a component attached thereto is acidic. However, the presence of calcium carbonate can neutralize the surface of the photosensitive member. It is thought that this action reduces an influence of the discharge product on the photosensitive member.

On the other hand, the calcium carbonate that chemically adsorbs the discharge product becomes more hydrophilic. Accordingly, the calcium carbonate is likely to adhere to the surfaces of the photosensitive member and surrounding members contacting the photosensitive member. If the more hydrophilic calcium carbonate adheres to the photosensitive member and the surrounding members and remains there, the calcium carbonate adsorbs the moisture, finally causing the image deletion. Particularly, the image deletion is remarkable in a portion of the surface of the photosensitive member that is in contact with or is close to the charging member. This fact may be because, since more discharge product is likely to be accumulated on the surface of the charging roller than on the surface of the photosensitive member, the calcium carbonate that adheres to the surface of the charging roller adsorbs the moisture and then moves to the surface of the photosensitive member.

Then, in order to remove the calcium carbonate having adsorbed the discharge product, the presence of the strontium titanate particles is important. While the strontium titanate particles do not react with the discharge product, the strontium titanate particles have a higher ability to adsorb the discharge product than that of silica, alumina, and titania. For this reason, by use of strontium titanate in combination, the discharge product and the calcium carbonate having adsorbed the discharge product can be scraped off and removed from the surface of the photosensitive member. Thus, the surface of the photosensitive member can be refreshed. Strontium titanate also has an appropriate degree of properties such as aggregation properties, polishing uniformity, slipping-through properties and adhesive properties needed in an apparatus configuration for polishing and cleaning the surface of the photosensitive member using the cleaning blade.

The above-mentioned action is demonstrated in a process step in which friction is produced between the image bearing member and other members in the state where hydrophobized calcium carbonate particles and the strontium titanate particles exist. Examples of such a step include a contact charging step, a contact developing step, a cleaning step, and an auxiliary step for cleaning or charging.

The calcium carbonate particles that can be used in the present invention are not particularly limited, and commercially available products thereof can also be used. Those obtained by any production method can also be used. Examples thereof may include natural calcium carbonate (heavy calcium carbonate) and synthetic calcium carbonate (light calcium carbonate or colloidal calcium carbonate).

In order to sufficiently exert an effect of inhibiting the image deletion in the present invention, the calcium carbonate particles need to have a number average particle diameter of 30 to 300 nm. An excessively small particle diameter is likely to cause aggregation of particles during the reaction with the discharge product to worsen a behavior as particles. Accordingly, the effect against the image deletion is difficult to obtain. At an excessively large particle diameter, the calcium carbonate particles come to insufficient contact with the surface of the photosensitive member, and the effect against the image deletion is also difficult to exert. The number average particle diameter of the calcium carbonate particles in the present invention is calculated by measuring 100 particle diameters at random from a picture of the particles taken by an electron microscope at a magnification of 50,000 and averaging the 100 particle diameters. The particle diameter of each particle was determined by (a+b)/2 wherein a represents the length of the longest side of the primary particle and b represents the length of the shortest side of the primary particle.

Calcium carbonate intrinsically has a strong reactivity with an acid and reacts in weakly acidic water at a pH of approximately 5 in a short time. As s result, desired physical properties of calcium carbonate may be impaired. Accordingly, in the case where calcium carbonate is used in the electrophotographic image forming method, in order to provide stability against moisture in the air, the surfaces of the calcium carbonate particles need to be hydrophobized. The hydrophobized calcium carbonate particles have a hydrophobicity, as measured with ethanol, of preferably not less than 30%, and more preferably not less than 50%.

Examples of a surface treatment for hydrophobization include a method of using a fatty acid or a derivative thereof, a resin acid or a derivative thereof, and other organic carboxylic acids or a salt thereof, a titanate coupling agent, and a silane coupling agent singly or in combination and making calcium carbonate particles adsorb the material. Among those materials, the fatty acids and derivatives thereof, and the resin acids and derivatives thereof are preferable.

The fatty acids or derivatives thereof are not particularly limited. For example, fatty acids, metal salts thereof, and esterification products thereof can be suitably used. Examples of the fatty acids include caproic acid, caprylic acid, lauric acid, myristic acid, palmitic acid, stearic acid, behenic acid, palmitoleic acid, oleic acid, and erucic acid. Examples of the metal salts include alkali metal salts such as sodium salts and potassium salts of the fatty acids, and alkaline earth metal salts such as magnesium salts and calcium salts thereof. Examples of the esterification products thereof include stearyl stearate, lauryl stearate, stearyl palmitate, and lauryl palmitate. These may be used singly or in combinations of two or more. Among these, fatty acids having 6 to 31 carbon atoms and derivatives thereof can be suitably used.

The resin acids and derivatives thereof are not particularly limited. For example, resin acids, metal salts thereof, and esterification products thereof can be suitably used. Examples of the resin acids include abietic acid, levopimaric acid, neoabietic acid, palustric acid, dehydroabietic acid, dihydroabietic acid, tetraabietic acid, dextropimaric acid, and isodextropimaric acid. Examples of the metal salts include alkali metal salts such as sodium salts and potassium salts of the resin acids, and alkaline earth metal salts such as magnesium salts and calcium salts thereof. Other than these, examples of the resin acid derivatives can include hydrogenated rosin, disproportionated rosin, polymerized rosin, rosin ester, maleinized rosin, maleinized rosin ester, and rosin-modified phenol.

The amount of the fatty acid, resin acid, or derivative thereof to be used can be properly determined according to the kind thereof. Usually, the amount may be 0.1 to 30 parts by mass, more preferably 0.2 to 20 parts by mass, and still more preferably 0.2 to 5 parts by mass based on 100 parts by mass of calcium carbonate.

Examples of a method for treating the surfaces of the calcium carbonate particles with these treating agents include a method for directly spraying a treating agent to calcium carbonate dry powder, a method for adding a treating agent to a slurry of calcium carbonate, a method for adding a treating agent to a dehydrated cake of calcium carbonate, and a method for wet grinding calcium carbonate. Preferably, a treating agent is added to a calcium carbonate-containing aqueous substance (a condensed solution prepared by condensing a calcium carbonate reaction slurry, a dehydrated cake obtained by dehydrating a light calcium carbonate reaction slurry, or an aqueous slurry obtained by dissolving light calcium carbonate dry powder), and mixed. Mixing is preferably stirring a solution, and performed using a mixing tank and a mixing pump. In the solution stirring apparatus, a baffle can be installed in order to enhance a shear force on the solution.

Strontium titanate in the present invention is not particularly limited, and commercial products thereof can also be used. Those obtained by any production method can also be used.

Examples of a method for producing strontium titanate include a method for mixing titanium oxide or metatitanic acid with strontium carbonate and firing the mixture. Moreover, examples of a method for producing finer strontium titanate particles include a normal pressure heating reaction method.

Examples of the normal pressure heating reaction method include a method for reacting a hydrolysate of a titanium compound with a strontium compound in a strongly alkaline aqueous solution to produce ultrafine particles of strontium titanate, a method for wet reacting a hydrolysate of a titanium compound with a strontium compound in the presence of hydrogen peroxide, a method for mixing a liquid strontium compound with a liquid or slurry titanium compound at a temperature at which the reaction starts or at a temperature more than that, and a method for performing the reaction by using a mineral acid peptized article of a hydrolysate of a titanium compound as a source of titanium oxide and a water-soluble acidic compound as a source of strontium, while an alkaline aqueous solution is added to the mixed solution at 50° C. or more.

In order to sufficiently demonstrate the image deletion inhibiting effect in the present invention, the number average particle diameter of the strontium titanate particle needs to be 30 to 300 nm. Such fine strontium titanate particles are very effective from the viewpoint of polishing and cleaning of the surface of the electrophotographic photosensitive member. At an excessively small particle diameter, mechanical load is not sufficiently applied when the strontium titanate particles are rubbed against the surface of the photosensitive member, such as in the cleaning step. For this reason, polishing properties cannot be demonstrated, and the effect against the image deletion is difficult to obtain. At an excessively large particle diameter, the strontium titanate particles insufficiently contact the surface of the photosensitive member, and the effect against the image deletion is also difficult to obtain.

Further, preferably, the particle diameter of the strontium titanate particles is substantially the same as that of the calcium carbonate particles. Specifically, the ratio (Ds/Dc) is preferably not less than 0.4 and not more than 2.5, wherein the number average particle diameter of the strontium titanate particles is represented by Ds, and the number average particle diameter of the calcium carbonate particles is represented by Dc. In that case, the particles of the two materials are easily uniformly mixed in a stagnation portion of the particles of the two types in the vicinity of the edge of the cleaning blade, to stabilize friction between the cleaning blade and the photosensitive member. For this reason, vibration caused by the friction between the cleaning blade and the photosensitive member can be reduced.

From the viewpoint of an improved scraping force, the shape of the particles is preferably aspherical, and more preferably prismatic, e.g., cubical. If the shape of the calcium carbonate particles and that of the strontium titanate particles are hexahedral, the image deletion can easily be reduced.

Strontium titanate has a new Mohs hardness of 6. Thus it is advantageous because the hardness does not allow the surface of the photosensitive member to be excessively scraped when the surface of the photosensitive member is polished.

In order to improve environmental stability and charging adjustment, the strontium titanate particles can be treated with a fatty acid, a resin acid, an inorganic oxide such as $SiO_2$ and $Al_2O_3$, a titanium coupling agent, a silane coupling agent, or a hydrophobizing agent such as silicone oil.

Particularly, the surfaces of the strontium titanate particles are preferably hydrophobized. The highly hydrophobic strontium titanate particles can reduce the amount of moisture to adsorb. In that case, adhesion of calcium carbonate having reacted with the discharge product to the charging roller can be suppressed, and reduction in the electric resistance of the surface of the charging roller and that of the surface of the photosensitive member can be suppressed. In order to demonstrate this effect, the strontium titanate particles have a degree of hydrophobicity measured with methanol of preferably 80% by volume or more. In order to uniformly attach an appropriate amount of the strontium titanate particles to the charging member to which calcium carbonate has been attached, the strontium titanate particles have a degree of hydrophobicity measured with methanol of preferably 95% by volume or less.

The surface treatment for hydrophobization of strontium titanate particles can be performed by the same treating method using the same treating agent as those for the calcium carbonate particles described above.

While depending on the kind of the fatty acid and the like, the amount of the fatty acid, resin acid or derivatives thereof to be used can be determined appropriately, the amount is approximately 1 to 20 parts by mass based on 100 parts by mass of strontium titanate. More preferably, the amount may be 3 to 15 parts by mass.

In the present invention, the hydrophobic property of the calcium carbonate particles and that of the strontium titanate particles, as represented by the hydrophobicity measured with methanol, is determined from a methanol dropping transmittance curve obtained in the manner stated below.

First, 70 ml of an aqueous methanol fluid having a known concentration (% by volume) of methanol is placed in a cylindrical glass container having a diameter of 5 cm and a wall thickness of 1.75 mm. In order to remove bubbles and the like in the sample to be measured, the solution is dispersed with an ultrasonic disperser for 5 minutes.

Next, 0.1 g of the particles to be measured is precisely weighed and placed in the container containing the aqueous methanol fluid to prepare a sample fluid to be measured.

Then, the sample fluid to be measured is set in a powder wettability tester "WET-100P" (made by Rhesca Corporation). The sample fluid to be measured is stirred at a velocity of 6.7 $s^{-1}$ (400 rpm) using a magnetic stirrer. As a rotor of the magnetic stirrer is used a spindle-like rotor, coated with a fluorine resin and having a length of 25 mm and a maximum body diameter of 8 mm.

Figure 3:
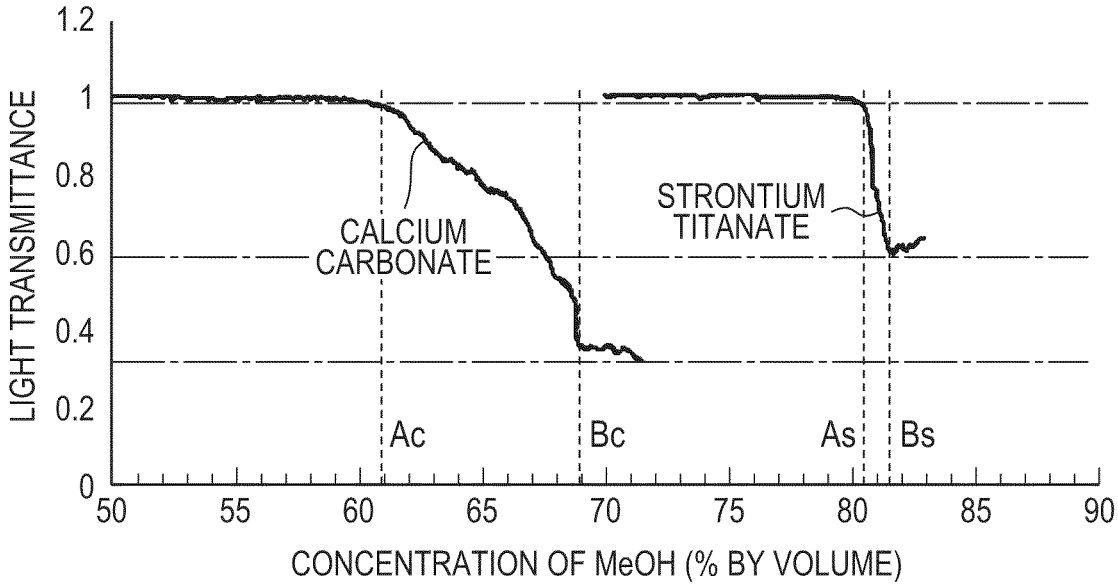
FIG. 3 illustrates an example of a measurement result of hydrophobicity using a powder wettability tester "WET-100P."

Next, the transmittance is measured with a light with a wavelength of 780 nm while methanol is continuously dropwise added to the sample fluid to be measured at a dropping rate of 1.5 ml/min through the apparatus. Then, a graph of methanol dropping transmittance curve is prepared in which the abscissa is a concentration of the methanol based on the volume (see FIG. 3). In the methanol dropping transmittance curve, a light transmittance reduction starting point is defined as the concentration of methanol at a point of intersection between the base line before the transmittance is reduced and a tangent line at a point at which the transmittance is reduced by 0.1. Moreover, a light transmittance reduction ending point is defined as the concentration of methanol when the reduction rate of the transmittance per a concentration of methanol of 0.1% is not more than 0.01. In the case where the methanol dropping transmittance curve is not smooth, the light transmittance reduction starting point may be determined by drawing a tangent line in conformity with the shape of the curve in the vicinity of the point at which the transmittance is reduced by 0.1, instead of the tangent line at the point at which the transmittance is reduced exactly by 0.1. Similarly, the light transmittance reduction ending point may be determined by visually judging the point at which no reduction of the transmittance is found, instead of exactly judging the point at which the reduction rate of the transmittance per a concentration of methanol of 0.1% is not more than 0.01.

The hydrophobicity measured with methanol of the hydrophobized calcium carbonate particles in the present invention is calculated such that the hydrophobicity measured with methanol is an intermediate value between the concentration of methanol at the light transmittance reduction starting point (Ac) and that at the light transmittance reduction ending point (Bc). Namely, the hydrophobicity measured with methanol of calcium carbonate in the present invention is "(Ac+Bc)/2". Similarly, the hydrophobicity of the strontium titanate particles is an intermediate value between the concentration of methanol at the light transmittance reduction starting point (As) and that at the light transmittance reduction ending point (Bs), that is, "(As+Bs)/2".

If the hydrophobicity measured with methanol of the hydrophobized calcium carbonate particles is not less than 50% by volume and not more than 80% by volume, the adhesion of the particles to the image bearing member can be suppressed without impairing the ability to adsorb discharge products. If the hydrophobicity measured with methanol of the hydrophobized calcium carbonate particles is larger, the rate of neutralizing and adsorbing the discharge product on the charging member is reduced, and the discharge product is likely to remain on the charging member. Conversely, if the hydrophobicity measured with methanol of the hydrophobized calcium carbonate particles is smaller, the hydrophobized calcium carbonate particles are easily dissolved by an acid of the discharge products. Accordingly, the deteriorated calcium carbonate particles on the surface of the charging member are likely to move and adhere to the surface of the photosensitive member.

If the hydrophobicity measured with methanol of the strontium titanate particles is 80 to 95% by volume, it increases the ability to prevent reduction in the contact angle on the surface of the charging member due to the calcium carbonate particles. If the hydrophobicity measured with methanol of the strontium titanate particles is relatively high, the charging member can be prevented from being hydrophilic when the calcium carbonate particles and the strontium titanate particles adhere to the charging member. This can inhibit the calcium carbonate particles having reacted with and adsorbed the discharge product on the charging member from absorbing moisture and adhering to the photosensitive member while the apparatus is left in a highly humid environment.

Moreover, the breadth between the concentration of methanol of the light transmittance reduction starting point and that of the light transmittance reduction ending point are calculated as the distribution breadth of hydrophobicity. The distribution breadth of hydrophobicity of the calcium carbonate particles is "Bc−Ac" and the distribution breadth of hydrophobicity of the strontium titanate particles is "(Bs−As)."

If the distribution breadth of the hydrophobicity of the calcium carbonate particles is not less than 5% by volume and not more than 20% by volume, the particles can have a fast-acting and durable ability to adsorb the discharge products. The calcium carbonate particles are often exposed to the discharge products on the surface of the charging member for a long time. With the distribution of the hydrophobicity being made broadened to a certain extent, the particles having different rates of reacting with the discharge products may be caused to exist together, in which situation the adsorbing effect can be demonstrated for a long time.

If the distribution breadth of the hydrophobicity of the strontium titanate particles is not less than 1% by volume and not more than 5% by volume, the particles may have approximately uniform hydrophobic nature, which fact is preferable.

These effects can inhibit the image deletion which may occur at the position of the surface of the photosensitive member in contact with the charging member and a close position thereto after the apparatus is left for a long time.

Next, a step of forming an image will be described.

FIG. 1 illustrates an example of an image forming apparatus to which an image forming method according to the present invention can be applied. FIG. 1 is a vertical sectional view illustrating a schematic configuration of a digital copier. The copier illustrated in FIG. 1 includes a drum type electrophotographic photosensitive member 101 as an image bearing member. The photosensitive member 101 is rotated and driven in the arrow direction by a driving unit (not illustrated). Around the photosensitive member 101, a charging roller 102 as a primary charging unit, an exposing unit 103, a developing unit 104, a transfer charging unit 105, and a cleaning apparatus 107 are arranged substantially in this order in the rotating direction of the photosensitive member. Further, a fixing unit 106 is arranged downstream of the transfer charging unit 105 in the conveying direction (arrow direction) of the transfer material 108 (on the left in the figure).

At a charging step, the photosensitive member is uniformly charged by discharging between the charging member (charging roller 102) having a bias applied and the photosensitive member 101. At this time, a discharge product is produced with the discharging phenomenon. The surface of the photosensitive member 101 is charged by the charging roller 102.

The charging method is mainly classified into a corona charging method and a contact roller charging method. The corona charging method is a method in which discharging is performed from a wire toward the photosensitive member, and the charges produced with the discharging are placed on the photosensitive member. The contact roller charging method is a method in which micro gaps are formed between the photosensitive member and a conductive roller, and the charges are placed on the surface of the photosensitive member by the discharging in the micro gaps.

Next, the charges in portions to be irradiated with a laser beam are removed by the laser beam emitted from the exposing unit 103 to form an electrostatic latent image. The electrostatic latent image on the photosensitive member 101 is developed by a charged toner in the developing unit 104. The developed toner image on the photosensitive member 101 is transferred onto a transfer material 111 conveyed in the arrow direction by the transfer charging unit 105. The transfer material 111 after transfer of the toner image is conveyed to the fixing unit 106. There, heat and pressure are applied to the transfer material 111 to fix the toner image onto the surface of the transfer material. The transfer remaining toner that remains on the photosensitive member after transfer is recovered by the cleaning apparatus 107.

As a method for cleaning the toner on the electrophotographic photosensitive member, a brush roller, an elastic roller, or a cleaning blade formed of an elastic blade is usually used. A method of bringing the elastic blade into contact with the photosensitive member in the counter direction to the movement of the photosensitive member can simplify the configuration and is most often used.

According to a preferable embodiment of the present invention, the hydrophobized calcium carbonate particles and the strontium titanate particles, used in the present invention, form a stagnation portion upstream of a contact portion between the edge of the cleaning blade and the image bearing member to stagnate for a while and are removed by the cleaning blade after the stagnation. Only a constant amount of the particle can stagnate in the stagnation portion which is formed in the state that the movement of the particles is stemmed by the edge of the cleaning blade. For this reason, if fresh particles are designed to be supplied one after another, the already existing particles are naturally removed by the cleaning blade. Thereby, the hydrophobized calcium carbonate particles that have stagnated in the stagnation portion and adsorbed the discharge products are scraped and removed by the strontium titanate particles. Moreover, the surface of the photosensitive member is polished by the strontium titanate particles at the same time.

As the material of the cleaning blade, rubbers materials are suitable from the viewpoint of followability to the surface of the photosensitive member and resistance against scratches. Among them, polyurethane rubbers are most suitable from the physical and chemical viewpoints. A rubber hardness is preferably an international rubber hardness degree (IRHD) of 60 to 90.

As a method of bringing an elastic blade into contact with the photosensitive member, preferably a rubber blade is fixed to the support inclined 15° to 45° with respect to the tangent of the photosensitive member in the blade contacting position and contacted with the support so as to be counter to the support. While the blade contact pressure depends on the toner to be cleaned and an external additive contained in the toner, the pressure of approximately 0.1 to 1.0 N/cm is preferable.

Further, preferably, an auxiliary cleaning member such as a brush roller is provided upstream of the contacting position between the cleaning blade and the photosensitive member in the surface of the photosensitive member. The auxiliary cleaning member can weaken the adhesive force between the toner and the photosensitive member. Additionally, the auxiliary cleaning member can make the hydrophobized calcium carbonate particles and strontium titanate particles reaching the cleaning blade even, thereby to weaken the adhesive force of these particles to the photosensitive member.

A dedicated member for directly supplying each of the hydrophobized calcium carbonate particles and the strontium titanate particles to the image bearing member can be provided within the cleaning apparatus or the like so as to apply the particles to the image bearing member. Moreover, if the hydrophobized calcium carbonate particles and strontium titanate particles are externally added to the toner, the respective particles are liberated from the toner particles to adhere to the image bearing member in the developing step, the transferring step or the cleaning step. Subsequently, the hydrophobized calcium carbonate particles and strontium titanate particles adhering to the image bearing member are made even by the member contacting the image bearing member such as a cleaning blade or a brush roller. Thereby, the hydrophobized calcium carbonate particles and the strontium titanate particles can be uniformly applied onto the surface of the image bearing member. This method is preferable because the same effect can be obtained and at the same time, the apparatus can be simplified. While the hydrophobized calcium carbonate particles and the strontium titanate particles may be separately applied to the image bearing member, preferably those may be applied to the image bearing member at the same time.

The amounts of the hydrophobized calcium carbonate particle and strontium titanate particle to be applied can be adjusted according to a tolerance degree of the conditions such as the amount of the photosensitive member to be scraped, the amount of the discharge product in charging, or the temperature and humidity environment where the image forming apparatus is used. In the case of the method for externally adding the hydrophobized calcium carbonate particles and the strontium titanate particles to the toner, the content of each of both the particles is not less than 0.1% by mass and not more than 5.0% by mass based on the mass of raw materials as a guideline. On the other hand, the proportion (Wc/Ws) of the mass of the hydrophobized calcium carbonate particles to be applied (Wc) to the mass of the strontium titanate particles to be applied (Ws) is preferably not less than 0.5 and not more than 4. With the proportion of the application amounts controlled within the range, the effect are further improved of suppressing the image deletion during feeding the paper and of suppressing the image deletion after the apparatus is left for a long time.

After the particles are applied, preferably, an electric conductive member is brought into contact with the image bearing member, and a voltage having the same polarity as that of the voltage to be applied in the charging step is applied to the conductive contacting member. Thereby, inorganic fine particles can be electrostatically attracted to a desired place to stay. Accordingly, adhesion of the particles to the charging member can be suppressed.

Examples of the conductive contacting member include a brush roller, a rubber roller, and an elastic blade. The position of the conductive contacting member to be arranged is a position corresponding to a step after application of the particles. The position is preferably within the cleaning apparatus, and the cleaning member or auxiliary member thereof can play its role. Use of a conductive elastic blade as the conductive contacting member is preferable because it also can serve as the cleaning blade and has a high capability to intercept or dam up the particles.

Examples of a method for giving conductivity include a method for forming a thin film of a metal such as nickel on the surface of an elastic blade formed of a polyurethane elastomer by electroless plating, for example. Examples thereof also include the conventional method for adding a conductive filling material such as carbon black to a polyurethane elastomer to make the blade conductive. As the conductive filling material, other than carbon black, metals (e.g., Cu, Al, Nl and Ag), metal oxides, graphite, and conductive polymers may be used. Examples of an ion conducting agent include alkali metal salts such as sodium salts, potassium salts, and lithium salts, quaternary ammonium salts, bromides, nitrous acid salts, sulfuric acid salts, and perchloric acid salts.

The conductive cleaning blade preferably has a volume resistivity of $1\times10^{7}$ to $1\times10^{10}\Omega\cdot$cm. At a proper value of the resistivity, fluctuation in the resistance value is reduced, and slipping-through of the calcium carbonate particles and strontium titanate particles is more stabilized. Accordingly, the amount of contamination of the charging member can be reduced and uneven contamination of the charging member can be prevented.

While the absolute value of the voltage to be applied to the conductive blade depends on the value of resistance of the rubber, the absolute value is preferably approximately 50 to 500 V, and the polarity of the voltage is the same as that of the voltage to be applied to the charging member.

A highly durable electrophotographic photosensitive member suitably used in the present invention will be described.

The electrophotographic photosensitive member used in the present invention preferably mainly has a laminated structure. An organic photosensitive member including a charge generation layer on a support, a charge transport layer thereon and a protective layer on the topmost surface is suitably used. Moreover, a binding layer and an undercoat layer for preventing interference fringes may be provided between the support and the charge generation layer.

Then, in order to obtain a highly durable photosensitive member, a protective layer containing, for example, a compound prepared by polymerizing a charge-transporting compound having two or more chain polymerizable functional groups in the same molecule as represented by the following formula:

$$[P^1\rightarrow_a A\rightarrow Z\rightarrow P^2]_d]_b$$

may be provided, wherein A represents a charge-transporting group; $P^1$ and $P^2$ represent a chain polymerizable functional group; $P^1$ and $P^2$ may be the same or different; Z represents an organic residue that may have a substituent; a, b and d represent 0 or an integer of 1 or more, and a+b×d represents an integer of 2 or more; if a is 2 or more, $P^1$ may be the same or different; if d is 2 or more, $P^2$ may be the same or different; and if b is 2 or more, Z and $P^2$ may be the same or different.

The charge-transporting compound having two or more chain polymerizable functional groups in the same molecule is polymerized. Thereby, in the protective layer, the charge-transporting compound is incorporated into a three-dimensional crosslinking structure at least two or more crosslinking points through a covalent bond. Only the charge-transporting compound can be polymerized, or the charge-transporting compound can be mixed with other compound having a chain polymerizable group. Any kind and ratio of the compound to be mixed are selected. The other compound having a chain polymerizable group here includes any monomers or oligomers/polymers having a chain polymerizable group. In the case where the functional group of the charge-transporting compound and the functional group of the other chain polymerizable compound are the same group or the groups polymerizable with each other, the functional groups can have a three-dimensional crosslinking structure through a covalent bond. In the case where the functional groups of the two compounds are those not polymerizable with each other, a photosensitive layer is configured so as to contain the other chain polymerizable compound monomer or a cured product thereof in a mixture of at least two or more three-dimensional cured products or a three-dimensional cured product as a principal component.

The protective layer can contain at least one selected from the group consisting of fluorine atom containing resins, carbon fluoride, and polyolefin resins as a lubricant. The protective layer may contain a dispersing agent for the lubricant, a dispersing aid, other various additives, a surface active agent, and the like.

The proportion of the lubricant contained in the protective layer is preferably 1 to 70% based on the whole mass of the layer serving as the surface layer. More preferably, the proportion is 2 to 20% in order to easily demonstrate the effect of a polishing agent with low hardness in the present invention.

The protective layer containing the cured product of the charge-transporting compound having a chain polymerizable group also can contain a charge transporting substance.

The protective layer is usually formed by applying a solution containing the charge-transporting compound, and performing a polymerization reaction. Other than this, a solution containing the charge-transporting compound is reacted in advance to obtain a cured product, and the cured product is dispersed or dissolved in a solvent again. Thus, the protective layer can also be formed. As the method for applying these solutions, immersion coating, spray coating, curtain coating and spin coating are known, for example. From the viewpoint of efficiency/productivity, immersion coating is preferable.

The charge-transporting compound having a chain polymerizable group is preferably polymerized by radiation. Most advantageously, no polymerization initiator is needed in the polymerization by radiation. Thereby, a highly pure three-dimensional photosensitive layer can be produced, and good electrophotographic properties are ensured. The radiation used at this time is an electron beam and γ rays.

The electrophotographic photosensitive member that demonstrates the effect by the present invention is not limited to the organic photosensitive member having the protective layer and the laminated structure. Use of a single layer organic photosensitive member or an amorphous silicon photosensitive member is also effective in the case where an image is formed under the condition of small wear of the photosensitive member and the problem to be solved is the deterioration of image quality due to the image deletion.

The toner contained in the developer has toner particles containing at least a binder resin, a colorant and a mold release agent. Any known materials can be used for these additives.

Further, when necessary, a variety of additives (e.g., charge control agent) may be contained.

As a fluidizing agent for controlling fluidity and developability, a known external additive can be added to the toner particles. As the external additive, a variety of inorganic oxidized fine particles of silica, alumina, titanium oxide, and cerium oxide, fine particles hydrophobized when necessary, vinyl polymers, zinc stearate, resin fine particles, or the like can be used. Improved fluidity leads to sufficient charging of the toner, which is performed by stirring the toner within the developing unit. As a result, a toner effective against fogging and toner scattering is obtained. The amount of the external additive to be added is preferably 0.02 to 5 parts by mass based on 100 parts by mass of the toner particles. The particle diameter of the external additive as the fluidizing agent is preferably approximately 1 to 30 nm.

Further, inorganic fine particles having an average particle diameter of 30 to 300 nm for cleaning and polishing the surface of the photosensitive member are externally added to the toner particles used in the present invention. From the viewpoint of the effect of cleaning the photosensitive member and an influence to developability, the amount of the polishing agent to be added is preferably 0.1 to 2 parts by mass based on 100 parts by mass of the toner particles.

Moreover, as the external additive, the hydrophobized calcium carbonate particles and the strontium titanate particles can be added to the toner particles. In this case, no member for supplying the particles to the photosensitive member needs to be newly provided. As a result, the apparatus can be simplified with a reduced space.

In the present invention, in the case where the hydrophobized calcium carbonate particles and the calcium titanate particles are externally added to and mixed with the toner, the total amount of the particles to be externally added is preferably 0.2 to 1.0 part by mass based on 100 parts by mass of the toner particles. At an amount of the particles to be externally added of less than 0.2 parts by mass, the amount of the particles to liberate from the toner to contribute to cleaning of the photosensitive member is sharply reduced. On the other hand, at an amount of more than 1.0 part by mass, a large amount of the particles are likely to be accumulated within the developing apparatus to significantly affect the developability.

Examples of a method for externally adding an external additive include a method for blending a predetermined amount of classified toner particles with a predetermined amount of an external additive, and stirring and mixing the mixture by using a high speed stirrer for giving a shear force to the powder such as a Henschel mixer and a super mixer as an external adding apparatus.

In the present invention, the developer may be a one-component developer composed of only a toner (contained no carrier), or may be a two-component developer composed of a toner and a magnetic carrier.

As the magnetic carrier, for example, particles of metals such as surface-oxidized or non-oxidized iron, lithium, calcium, magnesium, nickel, copper, zinc, cobalt, manganese, chromium, and rare earth elements, particles of alloys thereof, oxide particles, and ferrite can be used.

A coated carrier obtained by coating the surface of the magnetic carrier particle with a resin can be particularly preferably used in a developing method for applying an AC bias to a developing sleeve. As a coating method, a known conventional method can be used, for example, a method for attaching an application solution prepared by dissolving or suspending a coating material such as a resin in a solvent to the surfaces of the magnetic carrier core particles, and a method for mixing magnetic carrier core particles with a coating material in powder.

In the case where the toner of the present invention is mixed with the magnetic carrier to prepare a two-component developer, the ratio of the toner to be mixed is 2 to 15% by mass, preferably 4 to 13% by mass at a toner concentration in the two-component developer. Thereby, a favorable result is usually obtained.

Next, a method for producing the toner of the present invention will be described.

A binding resin, a colorant, a mold release agent and any material are molten and kneaded. The kneaded product is cooled, crushed, and pulverized by a airflow or mechanical mill. Subsequently, the pulverized product is classified and subjected to surface modification by a mechanical mill described later and a surface modifying apparatus described later that can perform classification and modification simultaneously, thereby to obtain toner particles. Further, an external additive is mixed to obtain a toner.

EXAMPLES

<Example of Production of Toner Particles>

| | |
|---|---|
| Polyester resin | 100 parts by mass |
| C.I. Pigment Blue 15:3 | 5 parts by mass |
| Normal paraffin wax (maxmal endothermic peak: 70° C.) | 5 parts by mass |
| Aluminum compound of 3,5-di-t-butylsalicylic acid (charge control agent) | 1 part by mass |

The materials were sufficiently mixed with a Henschel mixer in advance, and molten and kneaded with a biaxial extrusion kneader at a predetermined barrel temperature. After cooling, the kneaded product was crushed into approximately 1 to 2 mm using a hammer mill. As a first stage, the crushed product was pulverized with a pulverizer with a mechanical milling method at a processing rate of 50 kg per hour so as to have a particle diameter of 10 μm or less. Further, as a second stage, the pulverized product was ground with a mechanical mill in which a distance between a liner and a rotor was equally divided into 4 in the longitudinal direction of the rotor, and the distance was gradually reduced 0.1 times per divided section from the direction of feeding the ground product. The process with the mechanical mill was performed at a processing rate of 50 kg per hour. At this time, the temperature of a cold air was controlled, and the temperature of the exhausted air was 43° C.

Subsequently, the obtained pulverized product was classified and formed into a spherical shape with an apparatus that simultaneously performs classification and surface modification using a mechanical impactive force. Thus, toner particles were obtained. The obtained toner particles had a weight average particle diameter of 5.8 μm in particle diameter distribution, and the particles having an equivalent circle diameter of 2 μm or more as measured with a flow particle image measuring apparatus had an average circularity of 0.959.

<Calcium Carbonate Particles>

The calcium carbonate used in the present Example is a synthetic calcium carbonate produced by reacting calcium hydroxide with carbon dioxide gas. Hereinafter, the production method will be described.

200 ml of an ethanol/water mixed solution having a concentration of ethanol of 50% was cooled to −20 to 10° C., and 160 g of $Ca(OH)_2$ was added to the mixed solution. While the obtained slurry-like liquid was strongly stirred, a mixed gas of carbon dioxide gas/nitrogen having a concentration of carbon dioxide gas of 30% was introduced from the bottom of the container at a flow rate of 500 to 5,000 ml/min. The reaction was continued until the pH started to be reduced. At this time, the reaction temperature and the rate of introducing the carbon dioxide gas were controlled to obtain six kinds of slurries containing synthetic calcium carbonate particles having different particle diameters within the range of 20 to 350 nm. Further, each of the dispersion liquids was filtered at the continued low temperature. The obtained product was sufficiently washed with pure water and dried to obtain a synthetic calcium carbonate.

Water adjusted to 70° C. was added to the obtained synthetic calcium carbonate such that the solid content might be 10% by mass, and a slurry was obtained using a stirring type disperser. While 1 kg of the slurry of the synthetic calcium carbonate was stirred by the disperser, 0.2 to 4 g of saponified stearic acid was added. After stirring for 1 to 30 minutes, the slurry was press dehydrated. At this time, the amount of a fatty acid to be added and the stirring time were varied to obtain slurries of hydrophobized calcium carbonate having a different amount of fatty acid treatment and different distribution of the fatty acid treatment. The obtained dehydrated cake was dried and formed into powder. As a result, approximately 100 g of calcium carbonate was obtained which had been subjected to the hydrophobization surface treatment with a fatty acid.

Separately, an amorphous calcium carbonate having a particle diameter of 80 nm was prepared and formed into a slurry. Then, the hydrophobization surface treatment with stearic acid was performed in the same manner as above to produce a calcium carbonate particle c-24.

Table 1 shows the obtained hydrophobized calcium carbonate particles.

TABLE 1

| Particle No. | Material | Particle diameter (nm) | Degree of hydrophobizing by methanol (% by volume) | Distribution range of degree of hydrophobizing (% by volume) | Shape of particle |
|---|---|---|---|---|---|
| c-1 | Calcium carbonate | 20 | 65 | 8 | Hexahedral |
| c-2 | Calcium carbonate | 30 | 63 | 7 | Hexahedral |
| c-3 | Calcium carbonate | 80 | 65 | 8 | Hexahedral |
| c-4 | Calcium carbonate | 110 | 66 | 8 | Hexahedral |
| c-5 | Calcium carbonate | 200 | 68 | 6 | Hexahedral |
| c-6 | Calcium carbonate | 300 | 64 | 8 | Hexahedral |
| c-7 | Calcium carbonate | 350 | 65 | 8 | Hexahedral |
| c-8 | Calcium carbonate | 80 | 48 | 4 | Hexahedral |
| c-9 | Calcium carbonate | 80 | 48 | 6 | Hexahedral |
| c-10 | Calcium carbonate | 80 | 48 | 22 | Hexahedral |
| c-11 | Calcium carbonate | 80 | 50 | 5 | Hexahedral |

TABLE 1-continued

| Particle No. | Material | Particle diameter (nm) | Degree of hydrophobizing by methanol (% by volume) | Distribution range of degree of hydrophobizing (% by volume) | Shape of particle |
|---|---|---|---|---|---|
| c-12 | Calcium carbonate | 80 | 50 | 8 | Hexahedral |
| c-13 | Calcium carbonate | 80 | 50 | 20 | Hexahedral |
| c-14 | Calcium carbonate | 80 | 80 | 5 | Hexahedral |
| c-15 | Calcium carbonate | 80 | 80 | 9 | Hexahedral |
| c-16 | Calcium carbonate | 80 | 80 | 20 | Hexahedral |
| c-17 | Calcium carbonate | 80 | 82 | 4 | Hexahedral |
| c-18 | Calcium carbonate | 80 | 82 | 8 | Hexahedral |
| c-19 | Calcium carbonate | 80 | 82 | 22 | Hexahedral |
| c-20 | Calcium carbonate | 80 | 66 | 4 | Hexahedral |
| c-21 | Calcium carbonate | 80 | 65 | 5 | Hexahedral |
| c-22 | Calcium carbonate | 80 | 64 | 20 | Hexahedral |
| c-23 | Calcium carbonate | 80 | 63 | 22 | Hexahedral |
| c-24 | Calcium carbonate | 80 | 67 | 8 | Amorphous |

<Strontium Titanate Particles>

An aqueous titanium oxide slurry obtained by hydrolyzing a titanyl sulfate aqueous solution was washed with an alkaline aqueous solution. Next, hydrochloric acid was added to the slurry of the aqueous titanium oxide. The pH was adjusted to 0.65 to obtain a titania sol dispersion liquid. NaOH was added to the titania sol dispersion liquid, and the pH of the dispersion liquid was adjusted to 4.5. Washing was repeated until the electric conductivity of a supernatant solution reached 70 μS/cm. $Sr(OH)_2.8H_2O$ was added to the dispersion in an amount of 0.97 times that of the aqueous titanium oxide. The mixture was placed in an SUS reaction container, followed by replacement with nitrogen gas. Further, distilled water was added so that the mixture concentration is not less than 0.1 mol/l and not more than 2.0 mol/l in terms of $SrTiO_3$. The temperature of the slurry was raised to 83° C. at 1 to 25° C./hour in the nitrogen atmosphere. The reaction was performed for 3 to 7 hours after the temperature reached 83° C. After the reaction is completed, the slurry was then cooled to room temperature. The supernatant solution was removed, and washing with pure water was repeated. The temperature raising rate and reaction time of the slurry were varied to obtain various slurries of strontium titanate having different average particle diameters. Further, under the nitrogen atmosphere, the slurry was put into an aqueous solution in which 3 to 15% by mass of sodium stearate based on the solid content of the slurry was dissolved. While the solution was stirred, a zinc sulfate aqueous solution was dropwise added. Thereby, zinc stearate was precipitated on the surface of strontium titanate. The concentration of the sodium stearate aqueous solution and the dropping rate of the zinc sulfate aqueous solution were controlled to obtain various slurries of strontium titanate subjected to the hydrophobization surface treatment, the hydrophobicity and hydrophobicity distribution of which strontium titanate are different from each other. The slurries were repeatedly washed with pure water and filtered by a suction funnel. The obtained cakes were dried to obtain strontium titanate particles whose surfaces were treated with zinc stearate.

Separately, strontium titanate particles were prepared which were produced through a firing step in the following manner.

Strontium titanate obtained by reacting the titania sol with $Sr(OH)_2$ was fired at 1,000° C. and crushed until the primary average particle diameter reached 120 nm to produce a slurry. In the same manner as above, a strontium titanate particle s-16 was also produced which had been subjected to the hydrophobization surface treatment with zinc stearate.

Table 2 shows the obtained hydrophobized strontium titanate particles.

TABLE 2

| Particle No. | Material | Particle diameter (nm) | Degree of hydrophobizing by methanol (% by volume) | Distribution range of degree of hydrophobizing (% by volume) | Shape of particle |
|---|---|---|---|---|---|
| s-1 | Strontium titanate | 20 | 84 | 2 | Hexahedral |
| s-2 | Strontium titanate | 32 | 85 | 2 | Hexahedral |
| s-3 | Strontium titanate | 45 | 82 | 2 | Hexahedral |
| s-4 | Strontium titanate | 120 | 82 | 2 | Hexahedral |
| s-5 | Strontium titanate | 200 | 83 | 2 | Hexahedral |
| s-6 | Strontium titanate | 300 | 84 | 2 | Hexahedral |
| s-7 | Strontium titanate | 350 | 85 | 2 | Hexahedral |
| s-8 | Strontium titanate | 120 | 75 | 2 | Hexahedral |
| s-9 | Strontium titanate | 120 | 80 | 2 | Hexahedral |
| s-10 | Strontium titanate | 120 | 95 | 2 | Hexahedral |
| s-11 | Strontium titanate | 120 | 97 | 2 | Hexahedral |
| s-12 | Strontium titanate | 120 | 85 | 0.5 | Hexahedral |
| s-13 | Strontium titanate | 120 | 85 | 1 | Hexahedral |
| s-14 | Strontium titanate | 120 | 85 | 5 | Hexahedral |
| s-15 | Strontium titanate | 120 | 85 | 7 | Hexahedral |
| s-16 | Strontium titanate | 120 | 83 | 2 | Amorphous |

<Examples of Preparation of Toner>

Toners 1 to 46 were obtained in the following manner: 1.5 parts by mass of hydrophobic silica (produced by subjecting 100 parts of silica base particles to the surface treatment with 20 parts of dimethyl silicone oil, BET=220 $m^2/g$) and two types of particles, i.e., one selected from calcium carbonate particles c-1 to c-16 and one selected from strontium titanate particles s-1 to s-16 were externally added to 100 parts by mass of the toner particles with a Henschel mixer FM10B (made by Mitsui Miike Kakoki K.K.) under the conditions: the number of rotation of 66 $S^{-1}$ and time of 2 minutes. For comparison, Toner 47 was produced in which instead of the strontium titanate, 100-nm rutile type titanium oxide particles t (hydrophobicity of 84, and distribution breadth of hydrophobicity of 2) was externally added.

Table 3 shows the formulations of external addition for the obtained toners.

TABLE 3

| | Externally added particles | | | |
|---|---|---|---|---|
| | Particle No. | Amount of external addition (parts by mass) | Particle No. | Amount of external addition (parts by mass) |
| Toner 1 | c-3 | 0.2 | s-4 | 0.4 |
| Toner 2 | c-2 | 0.2 | s-3 | 0.4 |
| Toner 3 | c-5 | 0.2 | s-6 | 0.4 |
| Toner 4 | c-3 | 0.2 | s-2 | 0.4 |
| Toner 5 | c-6 | 0.2 | s-4 | 0.4 |
| Toner 6 | c-3 | 0.2 | s-5 | 0.4 |
| Toner 7 | c-4 | 0.2 | s-2 | 0.4 |
| Toner 8 | c-4 | 0.2 | s-6 | 0.4 |
| Toner 9 | c-11 | 0.2 | s-4 | 0.4 |
| Toner 10 | c-12 | 0.2 | s-4 | 0.4 |
| Toner 11 | c-3 | 0.2 | s-9 | 0.4 |
| Toner 12 | c-3 | 0.2 | s-10 | 0.4 |
| Toner 13 | c-15 | 0.2 | s-4 | 0.4 |
| Toner 14 | c-16 | 0.2 | s-4 | 0.4 |
| Toner 15 | c-3 | 0.2 | s-13 | 0.4 |
| Toner 16 | c-3 | 0.2 | s-14 | 0.4 |
| Toner 17 | c-9 | 0.2 | s-4 | 0.4 |
| Toner 18 | c-13 | 0.2 | s-4 | 0.4 |
| Toner 19 | c-14 | 0.2 | s-4 | 0.4 |
| Toner 20 | c-16 | 0.2 | s-4 | 0.4 |
| Toner 21 | c-16 | 0.4 | s-2 | 0.2 |
| Toner 22 | c-8 | 0.2 | s-4 | 0.4 |
| Toner 23 | c-9 | 0.2 | s-4 | 0.4 |
| Toner 24 | c-10 | 0.2 | s-4 | 0.4 |
| Toner 25 | c-17 | 0.2 | s-4 | 0.4 |
| Toner 26 | c-18 | 0.2 | s-4 | 0.4 |
| Toner 27 | c-18 | 0.2 | s-4 | 0.4 |
| Toner 28 | c-3 | 0.2 | s-8 | 0.4 |
| Toner 29 | c-3 | 0.2 | s-11 | 0.4 |
| Toner 30 | c-20 | 0.2 | s-4 | 0.4 |
| Toner 31 | c-23 | 0.2 | s-4 | 0.4 |
| Toner 32 | c-3 | 0.2 | s-12 | 0.4 |
| Toner 33 | c-3 | 0.2 | s-15 | 0.4 |
| Toner 34 | c-3 | 0.4 | s-4 | 0.2 |
| Toner 35 | c-3 | 0.1 | s-4 | 0.4 |
| Toner 36 | c-3 | 0.5 | s-4 | 0.2 |
| Toner 37 | c-3 | 0.1 | s-4 | 0.5 |
| Toner 38 | c-24 | 0.2 | s-4 | 0.4 |
| Toner 39 | c-3 | 0.2 | s-16 | 0.4 |
| Toner 40 | c-24 | 0.2 | s-16 | 0.4 |
| Toner 41 | None | — | None | — |
| Toner 42 | c-1 | 0.2 | s-4 | 0.4 |
| Toner 43 | c-7 | 0.2 | s-4 | 0.4 |
| Toner 44 | c-3 | 0.2 | s-1 | 0.4 |
| Toner 45 | c-3 | 0.2 | s-7 | 0.4 |
| Toner 46 | c-3 | 0.2 | None | — |
| Toner 47 | c-3 | 0.2 | (Titanium oxide particle t) | 0.4 |

<Example of Production of Carrier>

In the present Examples and Comparative Examples, for two-component developing using the toner and the carrier, a resin-coated ferrite carrier was produced by the method stated below.

Thermosetting resin: thermosetting phenol resin (curing temperature: 120° C.)

Thermoplastic resin: phenol novolak resin (softening point: 160° C.)

The two kinds of the thermosetting resin and the thermoplastic resin were mixed in a proportion of 30 parts by mass and 70 parts by mass, respectively, as the solid content and diluted by a methyl cellosolve solution to prepare 10% by mass of a coating resin solution. The coating resin solution was sprayed and applied to 1.5 kg of spherical ferrite particles (average particle diameter of 40 μm, and saturation magnetization of 20 $Am^2/kg$) using a fluid bed coater. At this time, the temperature of the air to be supplied to the fluid bed chamber was set to 40° C., and the rotational speed of a stirring blade was 450 rpm. As the spray condition, the air pressure on the spray nozzle was 3.4 $kg/cm^2$ (333 kPa), the flow rate was 48 l/min, and the feeding rate of the coating resin solution was 8.0 ml/min. After spraying was completed, the obtained carrier was kept in the fluid bed chamber at a temperature of 140° C. for 20 minutes to cure the thermosetting resin. Thus, a resin-coated carrier was obtained.

<Example of Production of Photosensitive Member>

A aluminum cylinder having a diameter of 60 mm was used as a support. Onto the support, a 5% by mass methanol solution of a polyamide resin (trade name: AMILAN CM8000, made by Toray Industries, Inc.) was applied according to dip coating to form an undercoat layer having a thickness of 0.5 μm.

Next, 3 parts by mass of crystal hydroxy gallium phthalocyanine having the strongest peak at a diffraction angle 2θ±0.2 of 28.1° in X ray diffraction of CuKα as a charge generating material and 2 parts by mass of polyvinyl butyral were added to 100 parts by mass of cyclohexanone, and the mixture was dispersed for 1 hour with a sand mill using glass beads with a diameter of 1 mm. To the mixture, 100 parts of methyl ethyl ketone was added for dilution to prepare a coating material for a charge generation layer. Onto the undercoat layer, the coating material for a charge generation layer was applied by the dip coating method and dried at 90° C. for 10 minutes to form a charge generation layer having a thickness of 0.17 μm.

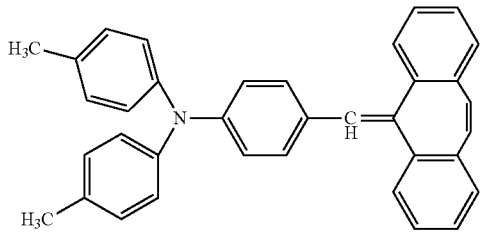

Next, 7 parts by mass of a charge transporting material compound represented by the following formula and 10 parts by mass of a polycarbonate resin (Iupilon Z400, made by Mitsubishi Engineering-Plastics Corporation) were dissolved in 105 parts by mass of monochlorobenzene and 35 parts by mass of dichloromethane. The solution was applied onto the charge generation layer according to the dip coating method and dried with a hot air at 110° C. for 1 hour to form a charge transport layer having a thickness of 13 μm. On the charge transport layer, a protective layer was further formed.

In the present Example, reversal development was used. The photosensitive member is an organic photosensitive member which was prepared by laminating the three layers on an aluminium cylinder with a diameter of 60 mm as described above and then applying and curing a surface layer containing a compound obtained by polymerizing a charge-transporting compound through irradiation with an electron beam as a surface protective layer, the charge-transporting compound being represented by the following formula:

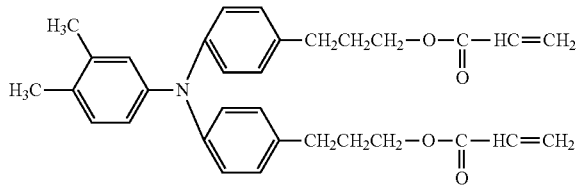

45 parts by mass of the charge-transporting compound was dissolved in 55 parts by mass of n-propyl alcohol. Further, 5 parts by mass of tetrafluoroethylene (PTFE) fine particle was added to prepare a coating material for a surface protective layer dispersed by a high pressure disperser (Microfluidizer, made by Microfluidics Corporation). The coating material was applied onto the photosensitive member and then irradiated with an electron beam at an accelerating voltage of 150 kV and a dose of 100 kGy to form a protective layer having a thickness of 4 μm. Thus, an electrophotographic photosensitive member was obtained.

<Cleaning Apparatus>

1 to 7% by mass of carbon fine particles (0.1 μm) and 1% by mass of zinc oxide fine particles (0.1 μm) were dispersed in a urethane rubber, and the mixture was molded in a mold while rotation was performed, thereby to produce a urethane rubber sheet having a thickness of 2 mm. The rubber sheet was attached to an SUS sheet metal to form a cleaning blade. The cleaning blade was set in a cartridge.

Figure 4:
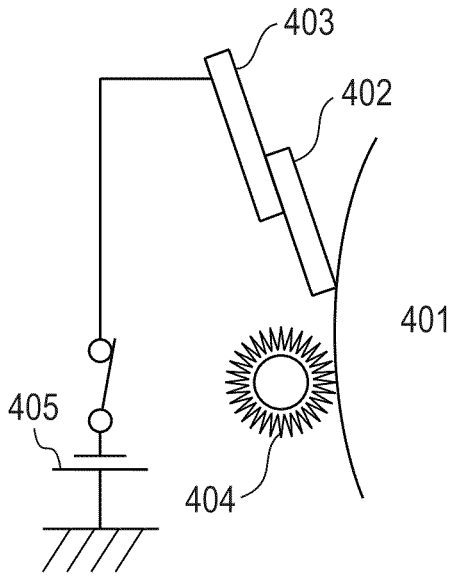
FIG. 4 is a schematic sectional view illustrating a cleaning apparatus.

Further, as illustrated in the cleaning apparatus of FIG. 4, a power supply 405 was connected to a sheet metal 403 having a cleaning blade 402 attached, and a DC voltage having the same polarity as that of the charged and applied voltage was applied.

Table 4 shows volume resistivities of the produced cleaning blades and the cleaning setting conditions according to the presence or absence of the application of voltage.

TABLE 4

| Cleaning setting | Volume resistivity of cleaning blade (Ω × cm) | Applied voltage (V) |
|---|---|---|
| 1 | $8 \times 10^6$ | −100 |
| 2 | $2 \times 10^7$ | −100 |
| 3 | $3 \times 10^9$ | −100 |
| 4 | $9 \times 10^9$ | −100 |
| 5 | $5 \times 10^{11}$ | −100 |
| 6 | $3 \times 10^9$ | 0 |

Example 1

Using a copier iRC3580 made by Canon Inc., image output was evaluated under the conditions stated below. The photosensitive member and magnetic carrier described above were used. A bias obtained by superimposing an AC bias on a DC bias was applied to the charging roller, and the Vpp of the AC bias was set such that the discharge current might be 100 μA. In the present Example, a cyan station was used. A developer prepared by mixing Toner 1 with the produced carrier was used, and the cleaning was Setting 3.

The ratio of the amount of calcium carbonate supplied to the surface of the photosensitive member to that of strontium titanate supplied to the surface of the photosensitive member was measured. The ratio used upon the external addition was maintained.

Evaluation was made according to the evaluation criteria reference below.

<Image Deletion During Formation of Image>

An environment for evaluation is 30° C. and 90% RH. 10,000 sheets of a 1-dot and 2-space horizontally ruled image were intermittently output one by one. The reduction in the width of the ruled lines in the images from the beginning to the 1,000th sheet was compared with that in the same image output in a 23° C. 5% RH environment. Thus, the image deletion caused during the formation of the image was evaluated.

A: Reduction in the ruled line width is less than 5% (apparent quality of the image is good).

B: Reduction in the ruled line width is not less than 5% and less than 10% (apparent quality of the image is good).

C: Reduction in the ruled line width is not less than 10% and less than 30% (apparent quality of the image is substantially good).

D: Reduction in the ruled line width is not less than 30% and less than 50% (apparent quality of the image is slightly inferior but tolerable).

E: Reduction in the ruled line width is not less than 50% (quality of the image is bad at a glance).

<Image Deletion after Apparatus is Left for a Long Time>

An environment for evaluation is 30° C. and 85% RH. A horizontally ruled chart (A4) with an image coverage of 4% was read with a scanner, and 10,000 sheets were intermittently output one by one. Immediately after the output, a 1-dot and 2-space horizontally ruled image was output, and the apparatus for evaluation was left for 2 weeks. After the 2-week leaving, the 1-dot and 2-space horizontally ruled image was output, and the image thus output was compared with the image obtained immediately before the apparatus was left. Thus, evaluation was made.

A: Reduction in the ruled line width is less than 5% (no reduction in the line is found).

B: Reduction in the ruled line width is not less than 5% and less than 10% (apparent quality of the image is good).

C: Reduction in the ruled line width is not less than 10% and less than 30% (apparent quality of the image is substantially good).

D: Reduction in the ruled line width is not less than 30% and less than 50% (apparent quality of the image is slightly inferior but tolerable).

E: Reduction in the ruled line width is not less than 50% (quality of the image is bad at a glance).

<Image Deletion Under Charging Member>

An environment for evaluation is 30° C. and 85% RH. A horizontal ruled line chart (A4) with an image coverage of 4% was read with a scanner, and 10,000 sheets were intermittently copied one by one. Then, the apparatus was left for 2 weeks. After that, a digital halftone highlight image was printed out. Evaluation was made about reduction in the density of image (dot area reduction rate) at the position corresponding to a contact area in which the charging roller was in contact with the photosensitive member during a period when the apparatus was left and to the vicinity of the contact area.

A: Dot area reduction rate is less than 10% (no reduction of the density is found).

B: Dot area reduction rate is not less than 10% and less than 20% (reduction in the density is slightly found, but hardly sensed).

C: Dot area reduction rate is not less than 20% and less than 40% (reduction in the density is slightly sensed).

D: Dot area reduction rate is not less than 40% and less than 70% (reduction in the density is sensed, but not problematic).

E: Dot area reduction rate is not less than 70% (reduction in the density is clearly sensed, and the appearance is bad).

<Striped Image Deletion>

An environment for evaluation is 30° C. and 85% RH. A horizontal ruled line chart (A4) with an image coverage of 4% was read with a scanner, and 10,000 sheets were intermittently copied one by one. Then, the apparatus was left for 2 weeks. After that, a digital halftone highlight image was printed out. Evaluation was made about reduction in the density of image (dot area reduction rate) at the position corresponding to a fine scratch on the photosensitive member.

A: Dot area reduction rate is less than 10% (no striped image deletion is found).

B: Dot area reduction rate is not less than 10% and less than 20% (striped image deletion is slightly found, but hardly sensed).

C: Dot area reduction rate is not less than 20% and less than 40% (striped image deletion is slightly found).

D: Dot area reduction rate is not less than 40% and less than 70% (striped image deletion is sensed, but not problematic).

E: Dot area reduction rate is not less than 70% (striped image deletion is clearly sensed, and the appearance is bad).

<Cleaning>

Under a high temperature and highly humid environment (30° C. and 85% RH), a horizontal ruled line chart (A4) with an image coverage of 0.5% was read with a scanner, and 2,000 sheets were intermittently printed out one by one. After that, the photosensitive member unit was removed from the main body of the apparatus and installed in an idling apparatus. A sound level of chatter noises when the driven photosensitive member was stopped was measured.

A: No noise is heard (less than 5 dB).

B: Noises are slightly heard, but hardly sensed (5 to 20 dB).

C: Noises are heard, but not problematic (21 to 40 dB).

D: Noises are clearly heard (not less than 41 dB).

<Contamination of Charging Member (Reduction in Potential>

As for an image forming pattern, a horizontal ruled line chart (A4) with an image coverage of 4% was read with a scanner. Under an environment of 30° C. and 85% RH, images were output to intermittently copy 10,000 sheets one by one. After that, under an environment of 23.5° C. and 5% RH, the potential of the surface of the photosensitive member was measured. Moreover, using a toner having no inorganic particle externally added, copying was performed under the same conditions, and the potential of the surface of the photosensitive member was measured in the same manner. Using the absolute value of the difference between the potentials of the surface of the photosensitive member in both cases, the contamination of the charging roller was evaluated.

A: Reduction of the potential is less than 2 V.

B: Reduction of the potential is not less than 2 V and less than 5 V.

C: Reduction of the potential is not less than 5 V and less than 10 V.

D: Reduction of the potential is not less than 10 V.

<Contamination of Charging Member (Uneven Potential)>

As for an image forming pattern, a horizontal ruled line chart (A4) with an image coverage of 4% was read with a scanner. Under an environment of 30° C. and 85% RH, image were output to intermittently copy 10,000 sheets one by one. After that, under an environment of 23.5° C. and 5% RH, a halftone image at a reflection density of 0.60 was output. The reflection density of the obtained image was scanned in the longitudinal direction of the charging roller to perform multipoint measurement. The difference of the density between multiple points was determined to evaluate the cause of uneven contamination of the charging roller.

A: The difference of the reflection density is less than 0.05 (uneven halftone density is hardly found).

B: The difference of the reflection density is not less than 0.05 and less than 0.10 (uneven halftone density is slightly found, but hardly sensed).

C: The difference of the reflection density is not less than 0.10 and less than 0.15 (uneven halftone density is found, but not problematic).

D: The difference of the reflection density is not less than 0.15 (uneven halftone density is clearly found).

Examples 2 to 45 and Comparative Examples 1 to 6

The same evaluation as that in Example 1 was made using different combinations between Toners 1 to 47 and Cleaning Settings 1 to 6. Table 5 shows the pattern of the combination between the toner and the cleaning setting.

TABLE 5

| | Toner | Cleaning setting |
|---|---|---|
| Example 1 | Toner 1 | Setting 3 |
| Example 2 | Toner 2 | Setting 3 |
| Example 3 | Toner 3 | Setting 3 |
| Example 4 | Toner 4 | Setting 3 |
| Example 5 | Toner 5 | Setting 3 |
| Example 6 | Toner 6 | Setting 3 |
| Example 7 | Toner 7 | Setting 3 |
| Example 8 | Toner 8 | Setting 3 |
| Example 9 | Toner 9 | Setting 3 |
| Example 10 | Toner 10 | Setting 3 |
| Example 11 | Toner 11 | Setting 3 |
| Example 12 | Toner 12 | Setting 3 |
| Example 13 | Toner 13 | Setting 3 |
| Example 14 | Toner 14 | Setting 3 |
| Example 15 | Toner 15 | Setting 3 |
| Example 16 | Toner 16 | Setting 3 |
| Example 17 | Toner 17 | Setting 3 |
| Example 18 | Toner 18 | Setting 3 |
| Example 19 | Toner 19 | Setting 3 |
| Example 20 | Toner 20 | Setting 3 |
| Example 21 | Toner 21 | Setting 3 |
| Example 22 | Toner 22 | Setting 3 |
| Example 23 | Toner 23 | Setting 3 |
| Example 24 | Toner 24 | Setting 3 |
| Example 25 | Toner 25 | Setting 3 |
| Example 26 | Toner 26 | Setting 3 |
| Example 27 | Toner 27 | Setting 3 |
| Example 28 | Toner 28 | Setting 3 |
| Example 29 | Toner 29 | Setting 3 |
| Example 30 | Toner 30 | Setting 3 |
| Example 31 | Toner 31 | Setting 3 |
| Example 32 | Toner 32 | Setting 3 |
| Example 33 | Toner 33 | Setting 3 |
| Example 34 | Toner 34 | Setting 3 |
| Example 35 | Toner 35 | Setting 3 |
| Example 36 | Toner 36 | Setting 3 |
| Example 37 | Toner 37 | Setting 3 |
| Example 38 | Toner 38 | Setting 3 |
| Example 39 | Toner 39 | Setting 3 |
| Example 40 | Toner 40 | Setting 3 |
| Example 41 | Toner 1 | Setting 2 |
| Example 42 | Toner 1 | Setting 4 |
| Example 43 | Toner 1 | Setting 1 |
| Example 44 | Toner 1 | Setting 5 |

TABLE 5-continued

| | Toner | Cleaning setting |
|---|---|---|
| Example 45 | Toner 1 | Setting 6 |
| Example 46 | Toner 41 | Setting 3 |
| Comparative Example 1 | Toner 42 | Setting 3 |
| Comparative Example 2 | Toner 43 | Setting 3 |
| Comparative Example 3 | Toner 44 | Setting 3 |
| Comparative Example 4 | Toner 45 | Setting 3 |
| Comparative Example 5 | Toner 46 | Setting 3 |
| Comparative Example 6 | Toner 47 | Setting 3 |

Example 46

Evaluation was made in the same manner as in Example 1 except that instead of externally adding calcium carbonate and strontium titanate to the toner, a powder prepared by mixing the calcium carbonate c-3 with the strontium titanate s-4 at a mass ratio of 1:2 was supplied to an auxiliary cleaning brush and supplied to the surface of the photosensitive member through the auxiliary cleaning brush. The amount of the powder to be supplied was adjusted so as to be substantially the same amount as that of calcium carbonate and strontium titanate to reach the cleaning blade when calcium carbonate and strontium titanate were supplied to the toner by external addition (0.4 to 2.0 g per 1,000 sheets of an A4 horizontal image to be output).

Table 6 and Table 7 show evaluation results of Examples 1 to 46 and Comparative Examples 1 to 6.

TABLE 6

| | Image deletion during formation of image | Image deletion after apparatus is left for long time | Image deletion under charging member | Striped image deletion | Cleaning | Contamination of charging member (reduction in potential) | Contamination of charging member (uneven charging) |
|---|---|---|---|---|---|---|---|
| Example 1 | A (2.1%) | A (2.5%) | A (3.2%) | A (2.7%) | A (2 dB) | A (0 V) | A (0.02) |
| Example 2 | A (1.9%) | B (7.4%) | B (12.5%) | B (10.9%) | A (4 dB) | A (1 V) | A (0.04) |
| Example 3 | B (7.6%) | A (3.3%) | A (3.5%) | A (3.6%) | A (4 dB) | A (0 V) | A (0.02) |
| Example 4 | A (2.0%) | B (6.8%) | B (15.8%) | B (15.8%) | B (16 dB) | A (1 V) | A (0.04) |
| Example 5 | B (8.1%) | A (2.9%) | A (3.9%) | A (3.9%) | B (14 dB) | A (0 V) | A (0.02) |
| Example 6 | A (2.0%) | A (2.7%) | A (2.9%) | A (2.8%) | B (15 dB) | A (0 V) | A (0.03) |
| Example 7 | A (3.4%) | B (8.0%) | B (14.0%) | B (13.9%) | C (27 dB) | A (0 V) | A (0.03) |
| Example 8 | A (2.9%) | B (8.3%) | B (14.2%) | B (14.3%) | C (34 dB) | A (0 V) | A (0.03) |
| Example 9 | A (1.7%) | A (3.0%) | B (17.7%) | A (8.6%) | A (3 dB) | A (0 V) | A (0.02) |
| Example 10 | A (2.3%) | A (2.6%) | B (19.1%) | A (8.8%) | A (3 dB) | A (0 V) | A (0.02) |
| Example 11 | A (2.1%) | A (2.8%) | B (19.6%) | A (7.7%) | A (3 dB) | A (0 V) | A (0.02) |
| Example 12 | A (2.1%) | A (2.6%) | B (18.8%) | A (6.8%) | A (3 dB) | A (1 V) | A (0.02) |
| Example 13 | A (2.0%) | A (2.9%) | B (17.6%) | A (7.9%) | A (3 dB) | A (0 V) | A (0.02) |
| Example 14 | A (2.2%) | A (3.2%) | B (18.5%) | A (9.0%) | A (3 dB) | A (0 V) | A (0.02) |
| Example 15 | A (2.0%) | A (2.6%) | B (18.6%) | A (7.2%) | A (3 dB) | A (0 V) | A (0.02) |
| Example 16 | A (2.0%) | A (2.7%) | B (17.9%) | A (7.5%) | A (3 dB) | A (0 V) | A (0.02) |
| Example 17 | A (2.1%) | A (2.8%) | B (18.0%) | A (7.6%) | A (3 dB) | A (0 V) | A (0.02) |
| Example 18 | A (2.0%) | A (2.9%) | B (17.9%) | A (7.7%) | A (3 dB) | A (0 V) | A (0.02) |
| Example 19 | A (2.2%) | A (2.6%) | B (18.1%) | A (7.8%) | A (3 dB) | A (0 V) | A (0.02) |
| Example 20 | A (2.2%) | A (2.7%) | B (17.9%) | A (8.1%) | A (3 dB) | A (0 V) | A (0.02) |
| Example 21 | A (1.8%) | B (7.3%) | B (19.8%) | B (16.0%) | B (18 dB) | A (1 V) | A (0.03) |
| Example 22 | A (2.0%) | A (2.8%) | C (37.3%) | A (6.9%) | A (3 dB) | A (1 V) | A (0.02) |
| Example 23 | A (1.6%) | A (3.3%) | C (35.6%) | A (8.9%) | A (3 dB) | A (0 V) | A (0.02) |
| Example 24 | A (1.6%) | A (3.0%) | C (36.7%) | A (7.9%) | A (3 dB) | A (0 V) | A (0.02) |
| Example 25 | A (3.0%) | A (2.6%) | C (28.8%) | A (6.7%) | A (3 dB) | A (0 V) | A (0.02) |
| Example 26 | A (2.5%) | A (2.8%) | C (30.3%) | A (6.3%) | A (3 dB) | A (0 V) | A (0.02) |
| Example 27 | A (2.3%) | A (2.7%) | C (29.9%) | A (8.0%) | A (3 dB) | A (0 V) | A (0.02) |
| Example 28 | A (2.1%) | A (2.9%) | C (28.8%) | A (7.1%) | A (3 dB) | A (1 V) | A (0.02) |
| Example 29 | A (2.2%) | A (2.7%) | C (29.2%) | A (6.5%) | A (3 dB) | A (0 V) | A (0.02) |
| Example 30 | A (2.0%) | A (2.6%) | C (34.0%) | A (6.3%) | A (3 dB) | A (0 V) | A (0.02) |
| Example 31 | A (2.0%) | A (3.1%) | C (38.1%) | A (8.2%) | A (3 dB) | A (0 V) | A (0.02) |
| Example 32 | A (2.1%) | A (2.8%) | C (33.3%) | A (7.8%) | A (3 dB) | A (0 V) | A (0.02) |
| Example 33 | A (2.0%) | A (2.8%) | C (36.5%) | A (7.7%) | A (3 dB) | A (0 V) | A (0.02) |
| Example 34 | A (2.2%) | B (7.9%) | B (12.0%) | B (14.9%) | A (4 dB) | A (0 V) | A (0.02) |
| Example 35 | B (7.7%) | A (2.8%) | A (8.1%) | A (6.8%) | A (3 dB) | A (0 V) | A (0.03) |
| Example 36 | A (2.0%) | C (19.4%) | C (37.1%) | B (19.4%) | A (4 dB) | A (0 V) | A (0.02) |
| Example 37 | C (13.9%) | A (2.6%) | A (6.3%) | A (4.9%) | A (3 dB) | A (0 V) | A (0.03) |
| Example 38 | A (3.1%) | A (2.7%) | A (5.1%) | C (37.1%) | A (3 dB) | A (1 V) | A (0.02) |
| Example 39 | A (2.6%) | A (3.0%) | A (4.6%) | C (38.7%) | A (3 dB) | A (1 V) | A (0.03) |
| Example 40 | A (3.6%) | A (3.3%) | A (9.4%) | D (59.9%) | A (3 dB) | A (1 V) | A (0.03) |
| Example 41 | A (2.0%) | A (2.6%) | A (3.8%) | A (4.0%) | A (3 dB) | A (0 V) | B (0.08) |
| Example 42 | A (2.1%) | A (2.7%) | A (3.9%) | A (3.9%) | A (3 dB) | A (0 V) | B (0.07) |
| Example 43 | A (2.1%) | A (2.6%) | A (3.6%) | A (6.6%) | A (3 dB) | A (0 V) | C (0.14) |
| Example 44 | A (2.1%) | A (2.7%) | A (5.0%) | A (6.2%) | A (3 dB) | A (0 V) | C (0.12) |
| Example 45 | A (2.0%) | A (2.6%) | A (6.1%) | A (7.8%) | A (3 dB) | C (9 V) | C (0.12) |
| Example 46 | A (1.8%) | A (1.6%) | A (2.4%) | A (2.2%) | A (3 dB) | A (1 V) | A (0.02) |

TABLE 7

| | Image deletion during formation of image | Image deletion after apparatus is left for long time | Image deletion under charging member | Striped image deletion | Cleaning | Contamination of charging member (reduction in potential) | Contamination of charging member (uneven charging) |
|---|---|---|---|---|---|---|---|
| Comparative Example 1 | E (65%) | A (2.8%) | C (36.2%) | A (4.6%) | D (46 dB) | A (1 V) | A (0.03) |
| Comparative Example 2 | E (78%) | A (2.6%) | C (34.0%) | A (4.4%) | C (33 dB) | A (1 V) | A (0.02) |
| Comparative Example 3 | B (6.4%) | E (79.5%) | E (88.7%) | E (77.7%) | C (31 dB) | A (1 V) | A (0.04) |
| Comparative Example 4 | B (8.0%) | E (69.2%) | E (90.6%) | E (70.8%) | D (55 dB) | A (1 V) | A (0.02) |
| Comparative Example 5 | B (6.4%) | E (87.7%) | E (89.5%) | E (94.2%) | C (38 dB) | A (0 V) | A (0.02) |
| Comparative Example 6 | C (11.6%) | E (83.1%) | E (92.2%) | E (86.6%) | C (26 dB) | A (0 V) | A (0.02) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-152635, filed Jul. 5, 2010, which is hereby incorporated by reference herein in its entirety.

What is claimed is:

1. An image forming method comprising the steps of:

electrostatically charging an image bearing member in association with discharging;

forming an electrostatic latent image on the surface of the image bearing member;

developing the electrostatic latent image with a developer to form a toner image;

transferring the toner image onto a transfer material through or without an intermediate transfer member; and fixing the toner image on the transfer material, wherein, said method further comprises a step of applying onto the surface of the image bearing member, hydrophobized calcium carbonate particles having a number average particle diameter of 30 to 300 nm and strontium titanate particles having a number average particle diameter of 30 to 300 nm, wherein when, in the measurement of hydrophobicity with methanol, a concentration (% by volume) of methanol at a light transmittance reduction starting point of the hydrophobized calcium carbonate particles is represented by Ac; a concentration (% by volume) of methanol at a light transmittance reduction starting point of the strontium titanate particles is represented by As; a concentration (% by volume) of methanol at a light transmittance reduction ending point of the hydrophobized calcium carbonate particles is represented by Bc; and a concentration (% by volume) of methanol at a light transmittance reduction ending point of the strontium titanate particles is represented by Bs, the following expressions are satisfied:

$$50 \leqq (Ac+Bc)/2 \leqq 80$$

$$80 \leqq (As+Bs)/2 \leqq 95$$

$$5 \leqq Bc-Ac \leqq 20$$

$$1 \leqq Bs-As \leqq 5.$$

2. The image forming method according to claim 1, wherein the mass of the hydrophobized calcium carbonate particles to be applied to the image bearing member, Wc, and the mass of the strontium titanate particles to be applied to the image bearing member, Ws satisfy:

$$0.5 \leqq Wc/Ws \leqq 4.$$

3. The image forming method according to claim 1, wherein the number average particle diameter of the hydrophobized calcium carbonate particles, Dc, and the number average particle diameter of the strontium titanate particles, Ds, satisfy:

$$0.4 \leqq Ds/Dc \leqq 2.5.$$

4. The image forming method according to claim 1, wherein the hydrophobized calcium carbonate particles and the strontium titanate particles exist on the surfaces of toner particles.

5. An image forming method comprising the steps of:

electrostatically charging an image bearing member in association with discharging;

forming an electrostatic latent image on the surface of the image bearing member;

developing the electrostatic latent image with a developer to form a toner image;

transferring the toner image onto a transfer material through or without an intermediate transfer member; and fixing the toner image on the transfer material, wherein, said method further comprises a step of applying onto the surface of the image bearing member, hydrophobized calcium carbonate particles having a number average particle diameter of 30 to 300 nm and strontium titanate particles having a number average particle diameter of 30 to 300 nm, wherein the hydrophobized calcium carbonate particles and the strontium titanate particles have a hexahedral shape.

6. An image forming method comprising the steps of:

electrostatically charging an image bearing member in association with discharging;

forming an electrostatic latent image on the surface of the image bearing member;

developing the electrostatic latent image with a developer to form a toner image;

transferring the toner image onto a transfer material through or without an intermediate transfer member; and fixing the toner image on the transfer material, wherein, said method further comprises a step of applying onto the surface of the image bearing member, hydrophobized calcium carbonate particles having a number average particle diameter of 30 to 300 nm and strontium titanate particles having a number average particle diameter of 30 to 300 nm, wherein said method further comprises: after applying the hydrophobized calcium carbonate particles and the strontium titanate particles to the image bearing member and before charging the surface of the image bearing member, bringing an electric conductive member into contact with the image bearing member to adjust the charging polarity of the hydrophobized calcium carbonate particles and the strontium titanate particles, wherein a voltage having the same polarity as that of the voltage applied to the charging member at the charging step is applied to said electric conductive member.

7. The image forming method according to claim 6, wherein the electric conductive member is an elastic blade member comprising as a main component a urethane rubber having a conductive material dispersed and has a volume resistivity of not less than $1\times10^{7}\Omega\cdot$cm and not more than $1\times10^{10}\Omega\cdot$cm.

* * * * *